United States Patent [19]

Lovenduski

[11] 4,183,257

[45] Jan. 15, 1980

[54] SAFETY DEVICE FOR LOCKING THE POSITION OF A LEVER ARM

[76] Inventor: Timothy J. Lovenduski, Force, Pa.

[21] Appl. No.: 880,995

[22] Filed: Feb. 24, 1978

[51] Int. Cl.[2] ..... G05G 5/04

[52] U.S. Cl. ..... 74/475; 70/211; 74/526

[58] Field of Search ..... 70/202, 203, 211, 212; 74/526, 532, 475, 566

[56] References Cited

U.S. PATENT DOCUMENTS

| | | | |
|---|---|---|---|
| 3,067,629 | 12/1962 | Zurles | 74/526 |
| 3,128,635 | 4/1964 | Doolittle | 74/475 |
| 3,522,746 | 8/1970 | Reynolds | 74/566 |
| 3,595,040 | 7/1971 | Curl | 70/203 |
| 3,980,099 | 9/1976 | Youngblood | 137/382 |
| 4,077,276 | 3/1978 | Knox, Jr. | 70/203 |

*Primary Examiner*—Kenneth Dorner
*Attorney, Agent, or Firm*—Pearne, Gordon, Sessions, McCoy & Granger

[57] ABSTRACT

A safety device is disclosed for locking in an upright position a lever arm having a rotatable base with projecting stop portions. The safety device comprises a body having means at one end for pivotally mounting the body near the base of the lever arm. The body also has a recess located centrally on one side of the body and adapted to fit beneath the base of the lever arm. On each side of the recess are a pair of upwardly projecting fingers adapted to engage the stop portions of the rotatable base portion of the lever arm to lock the lever arm in its upright position. The device can be easily moved into place to maintain the lever arm in its inoperative or neutral position to prevent inadvertent movement of the lever arm in either direction.

12 Claims, 5 Drawing Figures

SAFETY DEVICE FOR LOCKING THE POSITION OF A LEVER ARM

BACKGROUND OF THE INVENTION

1. Field of the Invention

This invention relates to locking devices for mechanical control mechanisms or switches.

2. Description of the Prior Art

Control mechanisms comprising a lever arm projecting from a rotatable base having projecting stop portions are wellknown and commonly used in a variety of control applications. The lever arm or operating element is capable of movement in either direction about the axis of its rotatable base with the degree of movement limited by the stop portions which project from each side of the base. The rotatable base is mounted on the end of the shaft to which the control means are connected within a housing. The shaft is turned or oscillated by manual operation of the lever arm.

When projecting vertically upright, the lever arm is usually in its inoperative or neutral position with the base midway between its limiting stop positions, so that the control means connected to the shaft are inoperative. The lever arm is capable of moving to either of two operative positions at each of which one of the stop portions of the base contacts a fixed stop mounted adjacent to the base.

It is often desirable to maintain a lever arm in its neutral upright position for extended periods of time. However, in this position the lever arm is extremely susceptible to being bumped or hit, which may cause inadvertent movement of the lever arm which movement would be undesirable and may even be disastrous depending upon the mechanism being controlled.

Various devices have been developed for locking switches, handles and other elements to prevent inadvertent movement thereof. For example, U.S. Pat. No. 3,980,099, issued to G. V. Youngblood, discloses a guard which attached over the rotatable handle of a valve. U.S. Pat. No. 3,522,746, issued to C. C. Reynolds, discloses a safety device for mounting over the projecting lever of a control element. U.S. Pat. No. 3,595,040, issued to R. D. Curl, discloses a locking attachment securable to the porjecting switch lever of a circuit breaker. All of these devices require some form of attachment over or around the projecting lever arm of the control device. In many instances, such attachment would be bulky, difficult to attach, and complicated in structure. In addition, the device mounted over the lever arm could obstruct other apparatus in proximity to the lever arm and thus cause more problems than it solves.

SUMMARY OF THE INVENTION

The disadvantages and shortcomings of the prior art are overcome by the present invention which provides a safety device for locking the position of the lever arm having a rotatable base with projecting stop portions. The safety device comprises a body having means at one end for pivotally mounting the body near the base of the lever arm. The body also has a recess located centrally on one side of the body adapted to fit beneath the base of the lever arm. On each side of the recess are a pair of upwardly projecting fingers adapted to engage the projecting stop portions on the rotatable base of the lever arm to maintain the lever arm in an upright position.

It is among the objects of the present invention to provide a safety device which will maintain the lever arm in its upright neutral position, and can be easily moved into its locking position without complicated, time consuming or tedious placement. Another object is to provide a safety device which will fit beneath the rotatable base of the lever arm in a convenient out-of-the-way position without attachment to the upwardly projecting lever arm so that operations may be carried on around the upper part of the lever arm without obstruction or interference from the locking device. Another object is to provide a safety device which utilizes the existing projecting stop portions of the rotatable base of the lever arm to lock the lever arm in its neutral position. Other objects will become apparent from the following detailed description of the preferred embodiment.

DETAILED DESCRIPTION OF THE PREFERRED EMBODIMENT

Figure 1:
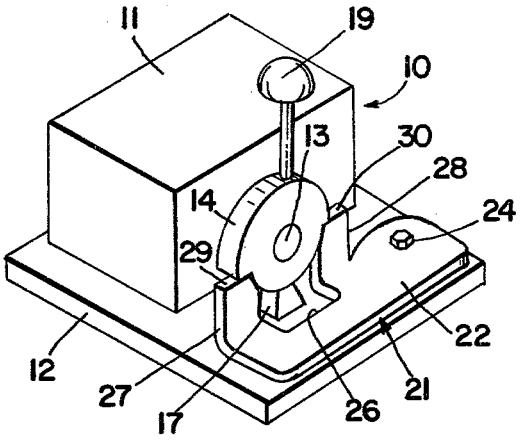
FIG. 1 is a perspective view of a lever arm control mechanism with the safety device of the present invention in its locking position.
Figure 2:
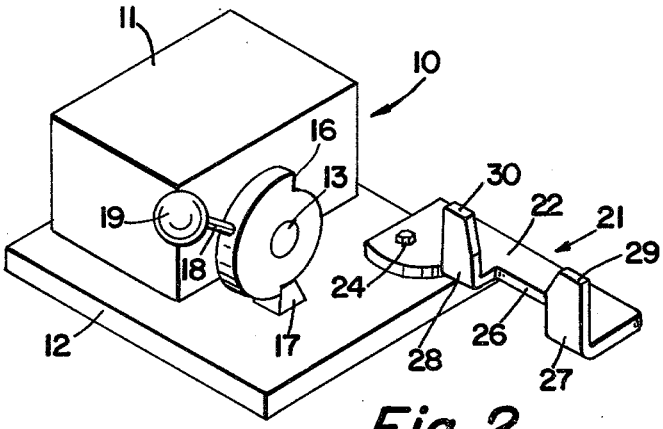
FIG. 2 is a perspective view similar to FIG. 1 showing the lever arm in an operating position with the safety device moved to its inoperative position.

Referring more particularly to the drawings and initially to FIGS. 1 and 2 there are shown a conventional lever-arm-type control mechanism 10 to which the safety device of the present invention is attached. The mechanism 10 comprises a housing 11 mounted on a support 12. The housing 11 contains the operating control means, such as transmission gears, circuit changing members, camming means, or other similar elements. Projecting from the housing 11 is a rotatable shaft 13 on which the control means in the housing 11 is mounted. On the end of the shaft 13 is mounted a rotatable base 14 which is generally cylindrical except for two projecting detents or stop portions 15 and 16. The stop portions 15 and 16 are adapted to engage a fixed upwardly projecting stop 17 mounted on the support 12 directly beneath the shaft 13. Extending from the base 14 is a lever arm or operating element 18 on the outer end of which is a hand knob 19.

Figure 4:
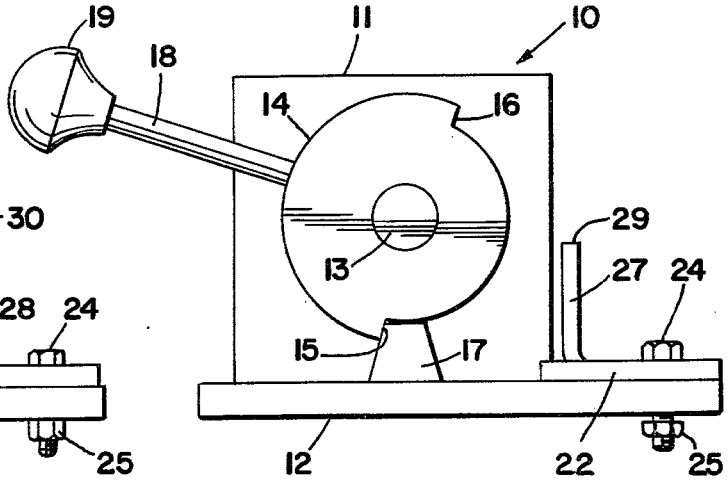
FIG. 4 is an end elevational view similar to FIG. 3 showing the lever arm and safety device in their positions of FIG. 2 with the lever arm in its operating position and the safety device moved to its inoperative position.

In the operation of the control mechanism 10, the lever arm 18 is positioned in its upright vertical position to maintain the control mechanism in its neutral or inoperative position. To actuate the mechanism, the lever arm 18 is moved in either direction about the axis of the rotatable base 14. When the lever arm 18 is moved in its forward direction (to the left as shown in the drawings), the base 14 turns, rotating the shaft 13 and changing the operating position of the control means within the housing 11 so that the control means is set in its forward position. The forward movement of the lever arm 18 is limited by the engagement of the stop portion 15 of the base 14 with the stop 17 mounted on the support 12 (FIG. 4). Alternatively, from its upright neutral position the lever arm 18 may be moved to its rearward position (to the right as shown in the drawings) which rotates the base 14 and the shaft 13 in the opposite direction, changing the operating position of the control means within the housing 11 to its reverse position. The movement of the lever arm 18 in this direction is limited by the engagement of the stop portion 16 of the base 14 with the stop 17.

In all instances in which it is undesirable to actuate the control mechanism in either direction, the lever arm 18 is maintained in its neutral vertical upright position. In this position, the upwardly projecting lever arm is susceptible to being inadvertently hit or bumped which would dislodge the control mechanism from its neutral position and cause the mechanism to be inadvertently actuated with resultant undesirable or even disastrous effects.

Figure 5:
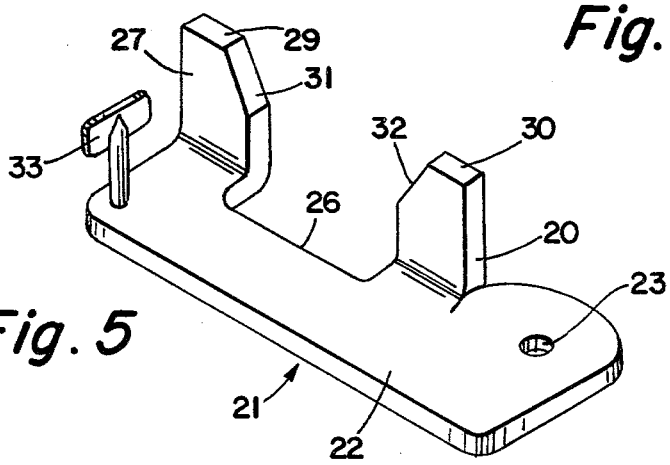
FIG. 5 is a detailed perspective view of the safety device of the present invention with the addition of a knob which may be used in moving the device between its locking position and its inoperative position.

To prevent this inadvertent movement of the lever arm, there is provided an attachment to the control mechanism in the form of the safety device 21 of the present invention as shown in detail in FIG. 5. The device 21 comprises a planar body 22 having at one end an opening 23 for pivotal attachment of the device to the support 12 using a suitable fastener such as a rivet or a bolt 24 and nut 25. Along one side of the body 22 is a recess 26. Flanking each side of the recess 26 and projecting upwardly and generally perpendicularly from the planar body 22 along the same side of the body as the recess is a pair of upwardly projecting fingers 27 and 28, each having a flat top edge portion 29 and 30. The fingers 27 and 28 extend generally perpendicular to the planar body 22. Each of the fingers 27 and 28 also has a bevelled side edge portion 31 and 32 extending from the upper edge of each finger along the side of the finger adjacent to the recess 26. If desired, a knob 33 (FIG. 5) may be added to aid in moving the device 21 into position. The knob 33 may comprise an upper handle portion on a shank having on its lower portion external threads by which the knob is mounted in an appropriate internally threaded opening in the body 22.

The safety device attachment 21 can be inexpensively fabricated from a piece of hot-rolled sheet steel having a preferred thickness of about ⅛ inch, for example. After stamping the appropriate shape from the sheet steel, the hole 23 is drilled, and the fingers 27 and 28 are bent upwardly to achieve the desired configuration.

Figure 3:
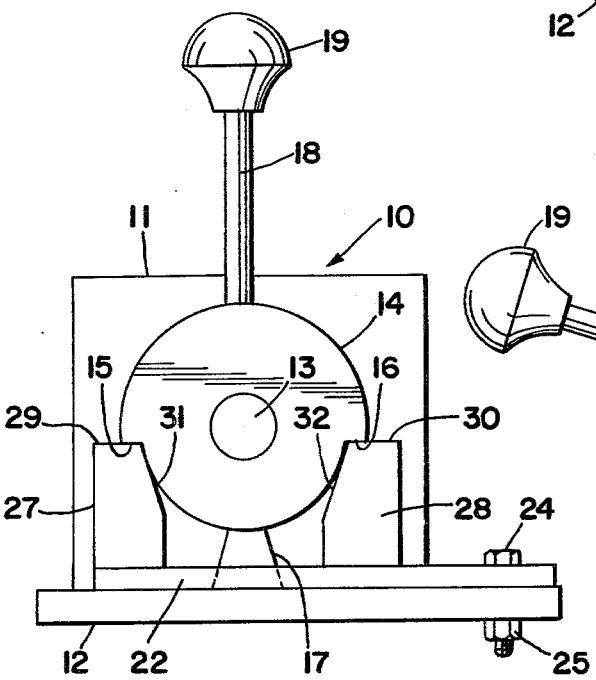
FIG. 3 is an end elevational view of the lever arm control mechanism and the safety device in the position of FIG. 1 with the lever arm in its neutral position and the safety device in its locking position.

As shown in FIGS. 1 and 2, the safety device 21 is preferably mounted on the support 12 to one side of the base 14 and the stop 17 beneath the base. When the lever arm 18 is in its neutral or upright position, the safety device 21 may be moved into its locking position as shown in FIGS. 1 and 3. In the locking position, the body 22 rests on the support 12 and fits beneath the base 14 with the recess 26 providing a clearance for the stop 17 projecting upwardly from the support 12. The base 14 fits between the upwardly projecting fingers 27 and 28 with the bevelled edge portions 31 and 32 providing clearance for the outer circular portion of the base 14 adjacent to the stop portions 15 and 16. Each of the stop portions 15 and 16 engage one of the top edges 29 and 30 of the respective fingers 27 and 28, thereby preventing any rotation of the base 14.

When it is desired to operate the control mechanism, the safety device 21 is pivoted on the fastener 24 outwardly away from the control mechanism to its unlocked position as shown in FIGS. 2 and 4. In the unlocked position, the lever arm 18 can be actuated in the normal manner. When the lever arm 18 is returned to its upright or neutral position, it can be locked in this position by returning the safety device to its locking position by moving the safety device inwardly toward the control mechanism, the device pivoting on the fastener 24. The knob 33 (FIG. 5) may be used to assist moving the device 21 between its locking and unlocked positions.

Although a particular type of lever-arm control mechanism is shown in the drawings, the invention can be applied to any other type of control mechanism or switch in which an operating shaft or rotatable member can be moved in either direction from a neutral position and has associated therewith an element having detents or stop portions thereon which limit the movement of the shaft in either direction.

While the invention has been shown and described with respect to a specific embodiment thereof, this is intended for the purpose of illustration rather than limitation, and other modifications and variations will be apparent to those skilled in the art all within the intended scope and spirit of the invention. Accordingly, this patent is not to be limited to the specific embodiment herein shown and described nor in any other way which is inconsistent with the extent to which the progress in the art has been advanced by the invention.

What is claimed is:

1. A safety device for attachment to and locking the position of a control mechanism having a rotatable element with projecting stop portions, the safety device comprising a body having means at one end for pivotally mounting the body to the mechanism near the rotatable element and having a recess located centrally on one side of the body adapted to fit beneath the rotatable element, the device having a pair of upwardly projecting fingers, one finger on each side of the recess, each of the fingers having a bevelled edge portion on the side of the finger adjacent to the recess adapted to fit on each side of the rotatable element, the fingers adapted to engage the stop portion of the rotatable element to maintain the control mechanism in its upright position.

2. A safety device as in claim 1, wherein the body is generally planar and the fingers extend perpendicularly to the body along the same side of the body as the recess.

3. A safety device as in claim 1, wherein the pivotally mounting means comprises a hole at one end of the body adapted to receive a fastener.

4. A safety device for locking the position of a control mechanism having a lever arm with a rotatable base having projecting stop portions, the safety device comprising a generally planar body having means at one end for pivotally mounting the body to the control mechanism near the base of the lever arm, the pivotally mounting means including a hole in the body adapted to receive a fastener, the body having a recess located centrally on one side of the body adapted to fit beneath the base of the lever arm, the device having a pair of upwardly projecting fingers extending perpendicularly to the body on the same side of the body as the recess, one finger on each side of the recess, each finger having a beveled edge portion on the side of the finger adjacent to the recess adapted to fit on each side of the base of the lever arm, each finger having a top edge portion adapted to engage the stop portions of the base of the lever arm to lock the lever arm in its upright position.

5. A lockable control mechanism which comprises:

a rotatable control element having projecting stop portions;

a fixed stop mounted adjacent to the control element and adapted to engage the projecting stop portions of the control element to limit the rotation of the control means in either direction; and a safety device pivotally mounted adjacent to the control element and capable of moving between an inoperative position and an operative locking position, the device having a recess located centrally on one side of the device adapted to fit around the fixed stop when the device is in its locking position, the device having a pair of upwardly projecting fingers, one finger on each side of the recess adapted to engage the projecting stop portions on said control element to lock said control element in a fixed position.

6. A control mechanism as in claim 5 wherein the safety device includes bevelled edge portions on the side of each of the fingers adjacent to the recess.

7. A control mechanism as in claim 5 wherein the safety device has a generally planar body and the fingers extend generally perpendicularly to the body along the same side of the body as the recess.

8. A control mechanism as in claim 5 wherein the control element comprises a lever arm having a rotatable base mounted on a shaft, the lever arm manually operable for rotating the base to actuate the control mechanism, the base having the projecting stop portions thereon.

9. A lockable control mechanism which comprises:

a shaft connected to control means;

a rotatable base on the shaft, the base having projecting stop portions;

operating means mounted on the rotatable base for manually rotating the base to actuate the control means;

a fixed stop mounted beneath the base for engaging the projecting stop portions on the rotatable base to limit the rotational movement of the base; and a safety device pivotally mounted near the base, the device having a body with a recess located centrally on one side, the recess dimensioned to fit around the fixed stop, the device having a pair of upwardly projecting fingers, one finger on each side of the recess, the fingers engaging the stop portions on the rotatable base of the lever arm to lock the lever arm in its upright position.

10. A control mechanism as in claim 9 wherein each finger has a bevelled edge portion on the side of the finger adjacent to the recess adapted to fit on each side of the rotatable base.

11. A control mechanism as in claim 9 wherein the body of the safety device is generally planar and the fingers extend perpendicularly to the body along the same side of the body as the recess.

12. A lockable control mechanism which comprises:

a shaft mounted on a support and operatively connected to control means;

a rotatable base on the end of the shaft, the base having radially outwardly projecting stop portions;

a lever arm projecting from the rotatable base for manually rotating the base to actuate the control means;

a fixed stop mounted on the support beneath the base for engaging the projecting stop portions on the rotatable base to limit the rotation of the base and the movement of the lever arm; and a safety device pivotally mounted on the support to one side of the base and capable of pivotally moving between an inoperative position and an operative locking position, the device having knob means for moving the device between the portions, the device having a generally planar body having a hole at one end for receiving a fastener to pivotally mount the body to the support, the body having a recess located centrally on one side of the body, the recess dimensioned to fit around the fixed stop when the device is in its locking position, the device having a pair of upwardly projecting fingers extending perpendicularly to the body on the same side of the body as the recess, one finger on each side of the recess, each finger having a bevelled edge portion on the side of the finger adjacent to the recess which fits on each side of the base when the device is in its locking position, each finger having a top edge portion which engages the stop portions of the base of the lever arm when the device is in its locking position to lock the lever arm in its upright position.

* * * * *